US007121287B2

(12) United States Patent
Carhuff et al.

(10) Patent No.: US 7,121,287 B2
(45) Date of Patent: Oct. 17, 2006

(54) SANITARY MANIFOLD SYSTEM AND METHOD FOR HYGIENICALLY DISPENSING FLUIDS

(75) Inventors: Peter W. Carhuff, Eau Claire, WI (US); Edward L. Dickinson, Littleton, MA (US); Andrew C. Harvey, Waltham, MA (US); Edward M. Kolvek, West Newbury, MA (US); Takeshi Masu, Ridgefield, CT (US)

(73) Assignee: Nestec S.A., Vevey (CH)

( * ) Notice: Subject to any disclaimer, the term of this patent is extended or adjusted under 35 U.S.C. 154(b) by 575 days.

(21) Appl. No.: 10/187,939

(22) Filed: Jun. 28, 2002

(65) Prior Publication Data

US 2004/0001906 A1 Jan. 1, 2004

(51) Int. Cl.
*B08B 9/00* (2006.01)
*B08B 9/02* (2006.01)
*B08B 9/023* (2006.01)

(52) U.S. Cl. ..... 134/169 R; 134/166 R; 137/240; 222/148

(58) Field of Classification Search ..... 134/95.1, 134/166 R, 169 R, 167 R, 167 C, 169 C; 137/240; 222/148; 99/452, 453
See application file for complete search history.

(56) References Cited

U.S. PATENT DOCUMENTS 4,211,342 A 7/1980 Jamgochian et al. .... 222/129.4
4,676,279 A * 6/1987 von Lersner ..... 141/1
4,941,593 A * 7/1990 Hicks et al. ..... 222/148
4,979,527 A * 12/1990 Mueller et al. ..... 137/15.06
5,601,127 A * 2/1997 Hanson ..... 141/91
5,797,519 A 8/1998 Schroeder et al. ..... 222/129.3
6,240,942 B1 6/2001 Ball ..... 137/1
6,240,952 B1 * 6/2001 Schroeder ..... 137/240
6,669,051 B1 * 12/2003 Phallen et al. ..... 222/1
6,889,603 B1 * 5/2005 Carhuff et al. ..... 99/452

FOREIGN PATENT DOCUMENTS

WO WO 200149154 A1 * 7/2001

* cited by examiner

*Primary Examiner*—Alexander Markoff
(74) *Attorney, Agent, or Firm*—Winston & Strawn LLP

(57) ABSTRACT

The present invention relates to the dispensing of a microbiologically sensitive fluid, in particular low acid food fluid, in a hygienic manner so as to avoid micro-organism growth in the line dispensing the fluid as well as in any mechanical components of a dispensing unit that may enter into contact with the fluid. The invention relates to a device for hygienically supplying microbiologically sensitive fluid from a removable container that has a terminal connecting portion to a dispensing unit. The device includes a coupling mechanism adapted to connect the terminal connecting portion and a component for delivering a cleaning or rinsing fluid within the terminal connecting portion.

21 Claims, 7 Drawing Sheets

SANITARY MANIFOLD SYSTEM AND METHOD FOR HYGIENICALLY DISPENSING FLUIDS

FIELD OF THE INVENTION

The present invention relates to the dispensing of a microbiologically sensitive fluid, in particular low acid food fluid, in a hygienic manner so as to avoid micro-organism growth in the line that dispenses the fluid as well as in any mechanical components of a dispensing unit that come into contact with the fluid. More particularly, the invention can be used for delivering with a high degree of food safety shelf stable milk-based concentrates from a dispensing unit to reconstitute a whitened beverage.

BACKGROUND ART

In the foodservice area, post-mix beverage dispensers are known which mix a concentrate or syrup with several measures of water and then dispense the mixture on demand to reconstitute a hot or cold beverage such as juice, carbonated sodas, coffee or tea. Coffee, tea or soda concentrates are relatively easy and safe to store in bags at ambient temperature as they usually contain a high amount of solids and/or sugar, a low pH and a low water activity, and these make them relatively stable over time. These concentrates can hardly become contaminated and the risk of food poisoning is very low.

More serious sanitary problems may occur with more microbiologically sensitive products, such as low acid fluids that can enter into the composition of an on-demand prepared beverage or food. For instance, milk is naturally a low acid fluid comprising a relatively balanced proportion of proteins, lipids and glucids with a pH of about 6.7. This formulation provides a favorable ground for critical bacterial growth. Milk can be rapidly spoiled when it becomes in contact with contaminated moisture, dust, fluid, etc., and thus proper handling and dispensing of such a product is tricky.

Therefore, in order to ensure a longer shelf life and prevent hygienic hazards, it is common to equip the dispensing system with a dry zone wherein the milk is provided under the form of powder, because that form is less sensitive to microbial growth. For example, U.S. Pat. No. 4,211,342 relates to a dispenser able to deliver hot and cold drinks that is relatively complex and uneasy to manage since both syrup and powder must be handled in order to reconstitute beverages.

Another solution for increasing the shelf life of a low acid fluid and reducing hazards due to bacterial growth in automated dispensers consists in maintaining refrigeration in the dispensing unit with a temperature range which is less favorable to rapid microbial growth, i.e., at or under 6–8° C. For example, U.S. Pat. No. 5,797,519 relates to a post-mix beverage dispenser for tea, coffee and the like in which refrigeration is maintained by a cooling unit. However, cooling does not eliminate the daily cleaning and sanitization requirements for the dispenser. Furthermore, refrigeration only slows down the growth process but does not reduce all bacterial and hygienic problems. It also adds to the overall and maintenance costs of the machine and is energy consuming.

Therefore, there is a need for handling microbiologically sensitive fluids, such as milk-based components, that are used to form the composition of beverages or food preparations, more preferably without refrigeration, in a more effective and convenient way while reducing the risk of bacterial contamination and growth while constantly maintaining a high degree of food safety.

U.S. Pat. No. 6,240,952 relates to an aseptic product dispensing system which comprises a sanitary connection assembly interposed in fluid communication with a substantially aseptic product source and a substantially conventional product dispenser. The sanitary connection assembly is provided with an automated cleaning system whereby combination of pressurized gas, flushing fluid and/or sanitizing solution may be injected into, and thereafter evacuated from, the sanitary connection assembly. Product loading is carried out by automated engagement of a hose connector to a cavernous body that results in puncturing of a perforable cover that closes the hose connector. The connector is protected by a check valve for preventing backflow into the product after the membrane is broken. The connection of the bag to the sanitary connection is relatively complex and expensive, but without providing the desired improvements in cleaning efficiency and safety. More particularly, the hose connector is likely to cause important bacterial contamination and growth problems, in particular in the zone between the check valve and the pinched point located further upstream the hose portion. It is known that check valves are never perfectly air tight because of the possible rotation of the ball. If this critical portion becomes contaminated, the micro-organisms can rapidly grow and spoil the entry of the sanitary connection without any possibility to cure this hygienic issue except for replacement of the valve. Furthermore, the sanitary connection system is relatively complex by itself as it also requires two cavities selectively controlled by a valve to enable the flushing of inside entry of the connector independently from the dispensing line.

Accordingly, there is a need for an improved sanitary system that is not subject to these problems and disadvantages and can handle a microbiologically sensitive fluid, such as a shelf stable low acid concentrate, in a more reliable, effective, convenient, simpler and less costly way.

SUMMARY OF THE INVENTION

The present invention now resolves the problems of the prior art by providing a sanitary manifold system for hygienically supplying microbiologically sensitive fluid from a container to a dispensing unit. The container is of the type adapted to be connected to the system by a terminal connecting portion of the container.

The sanitary manifold system more specifically comprises a discharge line for delivering the microbiologically sensitive liquid to the dispensing unit, a cleaning fluid line assembly for supplying a cleaning or rinsing fluid to clean or rinse the discharge line, an interface port for establishing connection from the terminal connecting portion of the container to the discharge line, wherein the cleaning or rinsing fluid line assembly comprises a projection member, wherein the projection member is arranged to deliver cleaning or rinsing fluid within the terminal connecting portion of the container.

As a result of this configuration of the manifold system, it is possible to clean or rinse in the most critical part of the container, more particularly, within the terminal connecting portion of the container, so that microbial growth can successfully be prevented in this area. Indeed, although it is relatively easy to retain the source of sensitive fluid relatively free from contamination, it is more difficult with parts of the container that interfaces with the dispensing unit.

As other benefits of the invention, the container, the connection between the container and the manifold system can be simplified and significant savings can be made on the packaging cost.

In a preferred embodiment, the projection member is reciprocally mounted in the housing to move from a retracted position whereby the projection member is inset relative to the interface port to an inserted cleaning position whereby the projection member protrudes past the interface port within the terminal connecting portion. A cleaning liquid or rinsing fluid (hereinafter referred to by the general term "cleaning fluid") can flow within the terminal connecting portion periodically to allow a satisfactory level of hygiene to be maintained during operation. In particular, the terminal connecting portion can be cleaned thoroughly by the flow of a cleaning fluid such as hot water, a detergent and/or caustic solution.

In the retracted position, the interface port is left open for allowing the flow of the beverage or food components to evacuate out of the container through a portion of hose and the terminal connecting portion, then, through the discharge line. In the inserted position of the projection, the internal part of the terminal connecting portion including a certain portion of hose can thus be cleaned or rinsed in a very effective way. This moving arrangement also participates to the simplification of the container's packaging since the terminal connecting portion of the container can be made simpler as there is no requirement for specific built-in valve means to prevent backflow.

According to another aspect, the projection member has a terminal spear adapted to puncture a closing membrane of the terminal connecting portion of the container. Hence, the system enables to establish fluid connection with a sterile or aseptic container for the first use in a very reliable way and by a means well adapted for this purpose. Therefore, when a new container assembly is connected to the manifold system for the first time, the terminal connecting portion and its membrane can be cleaned before puncturing of the membrane to remove and clean the outside, non-sterile, part interfacing with the manifold system.

The cleaning fluid line assembly may preferably form a tubular hollow conduit that extends from a fluid inlet, to a fluid port of the projection member to supply cleaning or rinsing fluid within the terminal connecting portion. The fluid port, as well as the conduit, may thus be oriented in the same direction as the direction of the projection within the fitment, in order to provide sufficient velocity to the flow of cleaning fluid within the terminal connecting portion, for example to clean the inside of the fitment and a certain portion of the hose and also eventually remove solid deposits or residue such as milk solids that could have settled on internal surfaces, junction lines, crevasses, etc.

In order to promote return of the cleaning or rinsing fluid on the internal peripheral surface of the terminal connecting portion of the container, the discharge line extends from the interface port to a discharge outlet, at least partially, by a chamber located about the peripheral surface of the projection member. Hence, after the cleaning fluid has flowed due to a sufficient flow velocity, within the terminal connecting portion of the container up to a pinched point of the hose, the internal surfaces of the terminal connecting portion of the container can be properly wiped by the annular return flow created to properly evacuate the contaminants and/or solid residues in direction of the discharge line.

In a preferred aspect of the invention, an external valve of the device is provided to engage the hose of the container, in a region proximate the interface port, to maintain the upstream portion of the hose and package sterile and isolate them from the terminal connecting portion, such as the fitment and its short connected portion of hose, so as to allow cleaning or rinsing of this downstream portion up to the closing point of the valve. Therefore, it is possible to very efficiently flush the fitment and portion of tube up to the closing point and thus eliminate the possibility for microorganisms to freely grow in this area. This arrangement also enables to maintain aseptic or sterile conditions in the container and upstream the valve after the container's fitment has securely been connected at the interface port without the requirement for complex connections and valve means usually provided to prevent backflow of fluid or contaminants within the container.

The valve is preferably a pinched valve acting externally on the portion of hose. Since, there is no direct contact between the valve and the microbiologically sensitive fluid, the risks of contamination and growth are prevented and the risks of food residue accumulating in this area are reduced.

In a further aspect of the invention, a coupling means is provided to securely connect the terminal connecting portion of the container assembly to the interface port of the manifold system. For instance, the coupling means preferably comprises a spring loaded holder that complementarily fits receiving means of the fitment of the container, a seal between the interface port and fitment outlet and pressure means urging the receiving means of the fitment against the seal.

According to yet another aspect of the invention, the invention concerns a combination of a sanitary manifold system and a container adapted to be connected to the manifold system by a terminal fitment for hygienically supplying microbiologically sensitive fluid from the container to a dispensing unit. The container more particularly comprises an aseptic source of microbiologically sensitive product, a terminal fitment and a portion of hose connecting the source to the terminal fitment. The sanitary manifold system comprises a housing, a discharge line for delivering the microbiologically sensitive liquid to the dispensing unit, a cleaning fluid line assembly for supplying a cleaning or rinsing fluid to clean or rinse the discharge line, an interface port for establishing connection from the terminal fitment of the container to the discharge line, wherein the cleaning or rinsing fluid line assembly comprises a projection member, wherein the projection member is arranged to protrude past the interface port into the fitment so as to deliver cleaning or rinsing fluid within the terminal fitment. The aseptic source of microbiologically sensitive product is preferably milk-based concentrate, preferably kept in sterile and closed conditions, before the first opening of the container.

More preferably, the flow of the microbiologically sensitive fluid is controlled by a pinch valve closing the portion of hose at a pinch point and wherein the projection member delivers cleaning or rinsing fluid within the fitment and hose up to the pinch point.

Even more preferably, the terminal fitment is free of any internal valve but merely closed by a puncturable membrane and wherein the sanitary manifold assembly has puncturing means to puncture the membrane and thus open the container.

In a preferred aspect, the sanitary manifold assembly has coupling means and the fitment has receiving means to securely engage and lock the fitment at the interface port.

In yet another aspect of the invention, the invention relates to a method for hygienically supplying microbiologically sensitive fluid from a container, wherein the container is adapted to be connected to cleaning means by a terminal connecting portion, wherein a microbiologically sensitive liquid is dispensed from the container through a tube of the container to a discharge line of the cleaning means, a cleaning fluid line is supplied to clean or rinse the discharge line, wherein during cleaning or rinsing, the cleaning or rinsing fluid is discharged within the terminal connecting portion up to a closing point of the container thus, demarcating downstream the closing point, a part that is maintained clean and, upstream the closing point, a part of the container that is constantly maintained sterile. A generic version of this method includes fluidly blocking the fluid delivery tube at a closing point; and connecting a discharge line of a cleaning fluid line to the terminal connecting portion to supply cleaning fluid to clean or rinse the terminal connecting portion and a portion of the discharge line up to the closing point, while maintaining that portion of the fluid delivery tube and container in a sterile state.

The invention also relates to a container adapted for hygienically supplying microbiologically sensitive fluid from the container to a dispensing unit and adapted to be removably connected to a sanitary manifold system as aforementioned in the broadest terms comprising:

an aseptic source of microbiologically sensitive product, a fitment, a portion of hose connecting the source to the terminal fitment and a closing means that maintains the source aseptic before the first opening of the container.

The invention further relates to a device for hygienically supplying microbiologically sensitive fluid from a removable container comprising a terminal connecting portion to a dispensing unit, wherein the device comprises coupling means adapted to connect the terminal connecting portion and cleaning means for delivering a cleaning or rinsing fluid within the terminal connecting portion.

The cleaning means may preferably comprise a projection member arranged to protrude within the terminal connecting portion. The projection member may reciprocate by means of an actuating means such as a solenoid or an equivalent. The projection member may preferably serve to open the container to deliver the fluid in the dispensing line. The opening of the container may be made by puncturing a closing membrane of the container. The cleaning means preferably comprises at least one cleaning line adapted to deliver within the terminal connecting portion, a cleaning fluid selected among the group consisting of hot water, a chemical sanitizing agent and steam.

In a further preferred embodiment, a heat sealing means is arranged to engage and permanently seal a portion of the container.

BRIEF DESCRIPTION OF THE DRAWINGS

Other characteristics and advantages of the present invention will appear in the following description of a preferred embodiment of the invention, this embodiment being given by way of non-limiting examples with reference to the annexed drawings, in which.

DETAILED DESCRIPTION OF THE PREFERRED EMBODIMENTS

The present description is presented to enable any person of ordinary skill in the art to make and use the invention. Various modifications to the preferred embodiment will readily be apparent to those of ordinary skill in the art, and the disclosure set forth may be applicable to other embodiments and applications without departing from the spirit of the invention and the claims appended hereto.

Figure 1:
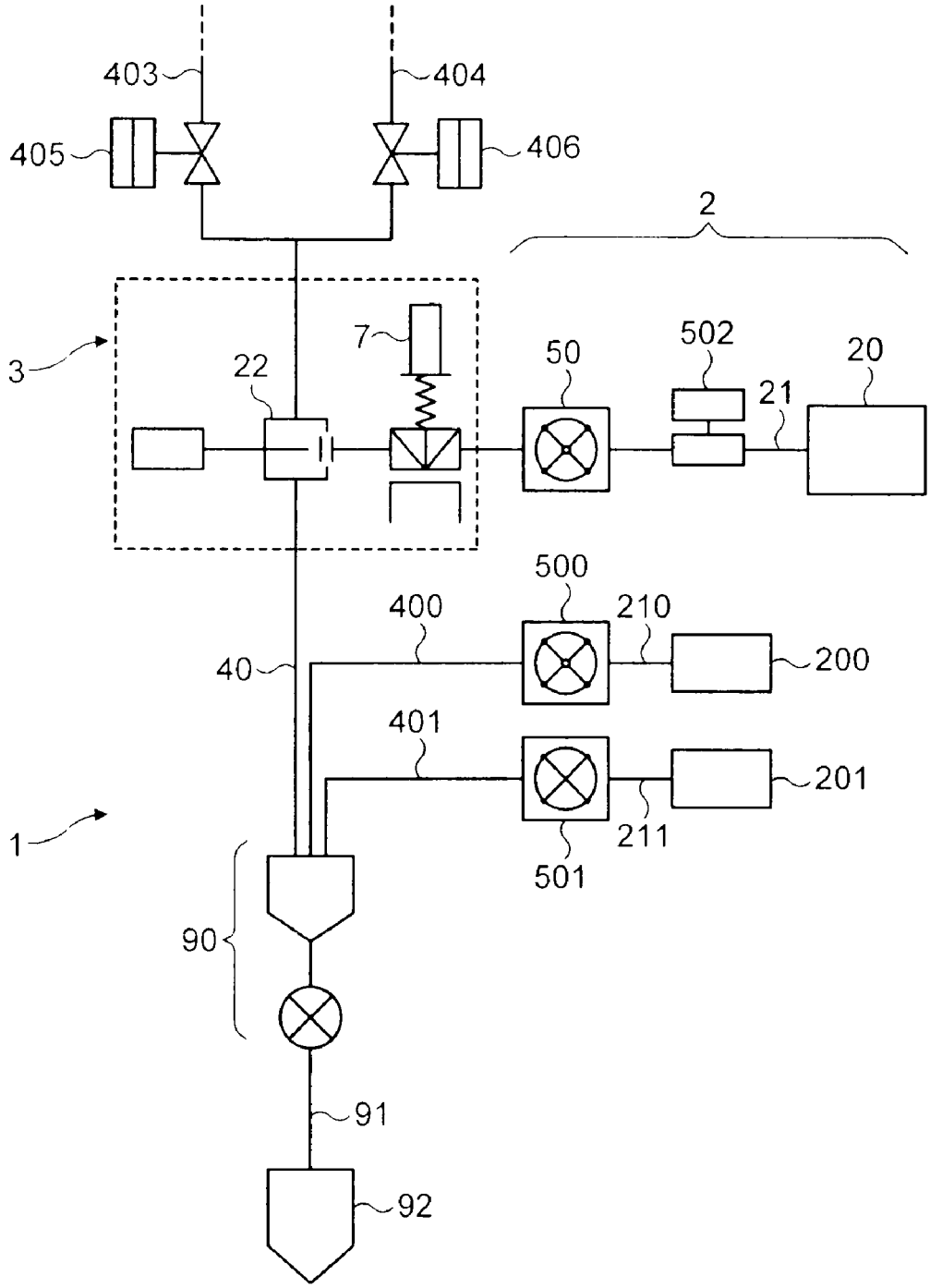
FIG. 1 is a schematic block diagram of a preferred embodiment of a simplified dispensing device integrating the sanitary manifold system of the present invention.

With reference first of all to FIG. 1, one can see a simplified dispensing device 1 adapted to provide a variety of hot and cold beverages by the combination of various concentrates, including microbiologically sensitive components such as milk concentrate, with water without the requirement for a refrigeration unit. For instance, the dispensing device 1 of the invention can deliver whitened hot or cold beverages on demand such as cappuccino, latte, coffee milk, chocolate or alternatively non-whitened beverages such as black coffee, tea, etc.

The concentrates are generally stored in bag-in-box type packages or similar disposable flexible packages. The microbiologically sensitive component that is a milk concentrate or milk based concentrate in the present context (hereinafter referred to by the general term "milk concentrate") is aseptically stored in a package 20 whereas less sensitive concentrates such as coffee and cocoa concentrates are respectively in packages 200, 201. The concentrates are transported in portions of hose, respectively, 21, 210, 211 connected to the packages by using pumps, such as peristaltic pumps, respectively, 50, 500, 501 that engage the portions of hose. In particular for the sensitive component package 20, the portion of hose 21 terminates by a fitment 22 hermetically closed by a tamper evident membrane (see FIG. 3). The package 20, the portion of hose 21 and its fitment 22, as closed by the closing membrane, form a container 2 that has a sterile interior for holding the microbiologically sensitive component. The container can thus be transported, handled and stored at ambient temperature with a shelf life of several weeks or months.

Before the first opening of the package 20 by breakage of the membrane, as it will explained in more detail later in the description, the content of the package is maintained in sterile conditions. Sterile conditions can be obtained by known means, preferably by sterilization of the container assembly 2 including the package 20, the portion of tube 21 and its fitment 22 and subsequent aseptic filling of the package with the microbiologically sensitive product. Preferably, sterilization is carried out by irradiation process but other means such as heat sterilization can be envisaged. It is preferred to build in a portion of hose 21 or attach such a portion to the pouch with its fitment prior to sterilization to ensure the complete assembly is sterile in one single part.

The dispensing device 1 of the invention is shown to generally include a sanitary manifold system 3 inserted in fluid communication with the aseptic source of microbiologically sensitive fluid 2 and a downward dispensing line 40 that can lead to a mixing or impeller device 90, to a delivery conduit 91 and nozzle 92. The mixing device also collects metered amounts of concentrates as delivered and dosed from the package 200, 201 through dispensing lines 400, 401 to reconstitute the beverage. The number of concentrates, pumps, dispensing lines leading to the mixing device is not limited and depends upon the desired complexity and type of dispensing devices.

The sanitary manifold system 3 is adapted for being selectively traversed and flushed by cleaning or rinsing fluids such as hot water, steam and chemical sanitizing agents coming from cleaning or rinsing lines 403, 404. The selection and opening of the cleaning or rinsing line can be made by means of valves 405, 406 controlled by a conventional controller (not shown). Typically, for milk-based concentrates, the sanitizing agents will be chosen from among the group including caustic soda, low foaming dishwater solutions, or chlorinated or phenolated solutions. The cleaning fluid also encompasses descaling agents such as acid solutions.

Figure 2:
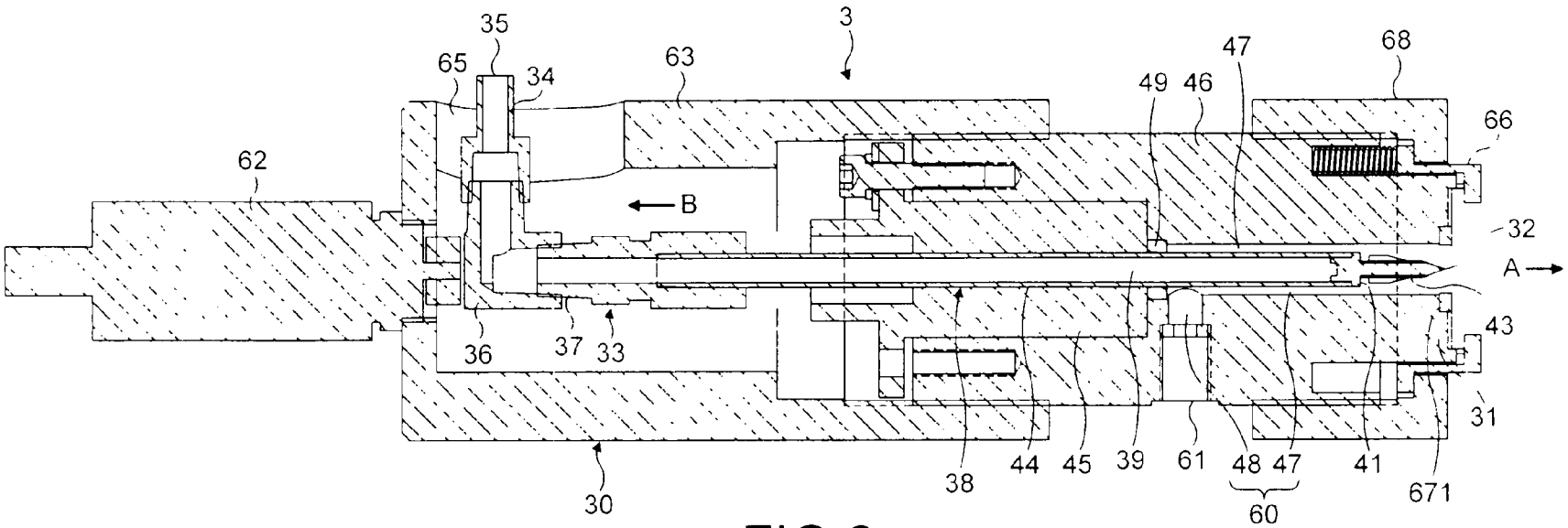
FIG. 2 is a longitudinal cross-section view of the sanitary manifold system of the present invention according to the preferred embodiment.

As shown in FIG. 2, the sanitary manifold system 3 comprises a housing 30 of substantially cylindrical shape. At a first end 31 of the housing is provided an interface port 32 adapted to receive in a removable manner the fitment 22 of the container 2. The housing has a hollow configuration with a central bore 44 to enable a moveable cleaning fluid line assembly 33 to be coaxially mounted within the bore. The cleaning fluid line assembly 33 comprises a first connector 34 that defines an inlet 35 for the cleaning or rinsing fluid to enter the manifold system at about 90 degrees relative to the longitudinal axis of the central bore. Connector 34 thus connects to a second intermediate L-shaped connecting part 36 of the line assembly that directs the flow of cleaning fluid along the longitudinal axis and connect itself to a third connecting part 37. The third connecting part 37 is attached to a projection member 38 comprising an axial conduit 39 for transporting the cleaning fluid up to a fluid port 41 located close to a terminal spear 43 of the projection member.

Figure 6:
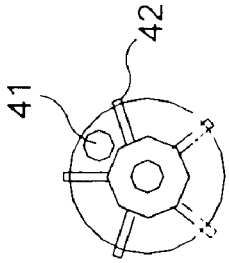
FIG. 6 is a front view of the projection of the manifold system.

The spear 43 has a sharp end capable of cutting a membrane of the fitment upon actuation of the projection member forward in a reciprocating manner. Since the parts 34, 36, 37 38, 43 are fixedly attached together, the whole line assembly 33 can reciprocate along the bore 44 of the housing. As illustrated in FIG. 6, the spear may preferably comprises a plurality of circumferentially oriented cutting splines arranged to cut open the membrane and provide a sufficiently wide opening in the fitment port for the flow of milk concentrate to properly traverse the fitment without retaining zones where solid deposits could easily settle. Furthermore, the splines also play a role to direct the flow of cleaning fluid toward the fitment and hose of the container.

More specifically, a portion of the projection member 38 is closely guided in axial movement along the portion of bore 44 of an internal body 45 of the housing. The internal body 45 is attached by means of a connection means such as screws to a front body part 46. The front body 46 comprises a chamber 47 of larger diameter than the external diameter of the projection member 38 so as to demarcate an annular room that extends inwardly from the interface port 32 to a discharge conduit 48 positioned at right angle with respect to the chamber 47. The chamber 47 and discharge conduit 48 form together a discharge line 60 that terminates by a discharge outlet 61. A sealing gasket 49 is provided between the internal body 45 and the projection member 38 to make the discharge line 60 inwardly watertight.

In the rear end of the housing is provided an actuator 62, preferably an electromagnetic solenoid actuator coaxially mounted on a rear hollow body part 63 of the housing. The actuator 62 is mounted in engagement with the cleaning fluid line assembly, more particularly to the second connector 36. The actuator can be of a push-and-pull solenoid type. Thus, in response to a control signal originating from a control circuit (not shown), the actuator pushes on the fluid line assembly 33, in the direction of arrow A as shown, which has the effect to move the projection member 38 and its spear 43 forward in an inserted position in which the tip of the spear extends beyond the interface port 32. When the actuator 62 is de-energized, the projection member stops in the inserted position. When the actuator is energized again, it tends to push the line assembly 33 back in a retracted position, i.e., in the direction of arrow B, in which the spear 43 is located in a position inset relative to the interface port 32. It can noted that the actuator could also be of a push type only and combined with a return spring inserted between body part 45 and the connector 3 that pushes the projection member back in retracted position upon de-energization of the solenoid (not shown).

As shown in FIG. 2, the rear body part 63 of the housing comprises an elongated orifice 65 of a shape and size adapted for the inlet and connector 34, 35 to move axially as an integral part of the whole fluid line assembly. Of course, the solenoid actuator could also be replaced by equivalent actuating means such as a cam mechanism, a worm gear or a rack and pinion system.

Figure 3:
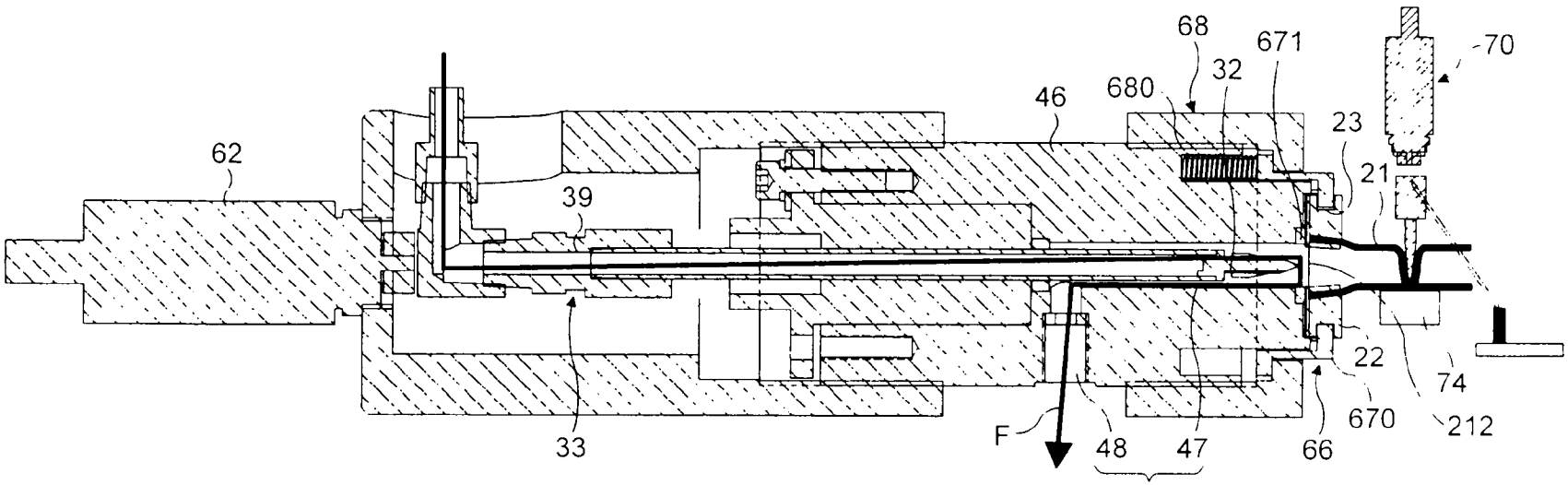
FIG. 3 is a view similar to FIG. 2 showing the cleaning routing before opening of the container.

As illustrated in FIG. 3, the sanitary manifold system comprises coupling means that complementary engages a terminal fitment of the container assembly. The configuration of the coupling means may widely vary depending upon the type and shape of the fitment to be locked in place. The coupling means should be able to provide a watertight connection at the interface port in order to establish a reliable and secure fluid communication between the portion of hose 21 and the discharge line 60 of the manifold system and avoid risks of fluid leakage outside the system. In a preferred mode, as shown, there is provided a spring loaded holder 66 having a ring shaped lip 670 adapted to engage a complementarily shaped annular groove 23 of the fitment. The fitment 22 is so urged in abutting contact with the end surface of housing against a seal 671 placed at the periphery of the interface port 32 by means of an outside retaining nut 68 that progressively forces on the holder 66 upon screwing on a portion of the body part 46 of the housing. Some elasticity is given on the holder to avoid permanent deformation of the elements and compensate for backlash by a spring or other elastic means 680 that is inserted between holder 66 and body part 46.

It is clear the connection between the fitment and the manifold system could be carried out by other equivalent mechanical means such as by a cam type mechanism or a lever type mechanism to provide the same result without departing from the spirit of the invention. It is also clear that the receiving means of the fitment could also be formed from a protruding part as opposed to an annular groove and the holder formed from a recess instead of an annular lip wherein the protruding part of the fitment would complementary fit the recess of the holder.

Figure 4:
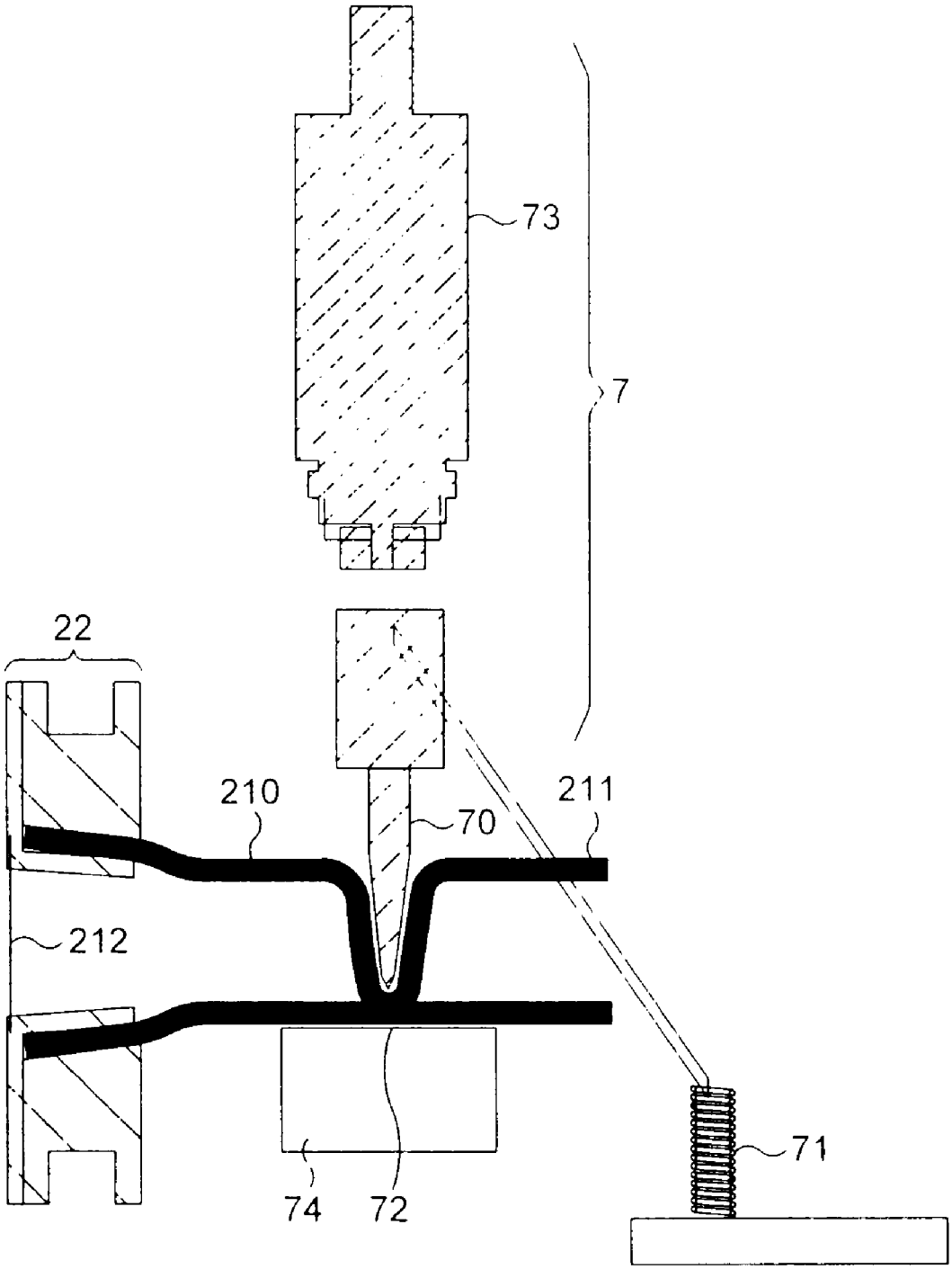
FIG. 4 shows a detail of FIG. 3, in particular, the configuration of the fitment when securely attached to the manifold system before the opening of the container.

Referring to FIG. 4, the system further comprises an external valve means 7 that is preferably situated as close as possible to the interface port and that externally engages the portion of hose of the container assembly. The external valve is preferably a spring loaded pinch valve with a pinching member 70, a pinch block 74 and a tension spring 71. The tension spring constantly maintains a certain closing pressure of the pinching member at a pinch point 72 on the hose and against the pinch block 74. Due to the tension of the spring, the valve acts passively in a rest configuration. The pressure exerted by the valve is typically sufficient to hermetically close the hose at the pinch point when the pump 50 is not in action. Hence, the portion of hose 211 situated upstream the pinch point can be maintained sterile in this rest situation.

When the pump is acting, the pressure exterted by the flow of the concentrate in the upstream part 21 of the hose is sufficient to overcome the threshold tension value of the spring and therefore to force the valve to open. By virtue of the flow force created and direction of the flow, microbial substances can not attain the upstream portion of hose which remains sterile.

In a cleaning situation where the cleaning fluid is pushed under pressure from the manifold system within the fitment and the downstream portion 210 of the hose, the threshold tension of the pinch valve can be raised to a higher value by an actuator 73 that exerts an additional pressure adding to the spring tension on the pinch member. Therefore, the threshold tension of the valve is increased sufficiently above the cleaning fluid pressure to ensure that no cleaning fluid can enter the sterile portion of the container.

Therefore, in all conditions, the portion 211 of hose past the pinched point can remain safely sterile while the portion 212 of hose prior the pinched point, which is no more sterile after breaking of the membrane, can be periodically cleaned and rinsed. As a result, the delivery conditions of the microbiologically sensitive fluid, e.g., milk concentrate, are safely controlled and refrigeration in the dispensing unit is not necessary.

Referring again to FIG. 3, it is more particularly shown the cleaning operation when a new container assembly is put in place and attached to the sanitary manifold system. Since the container assembly comprises external parts of the fitment and of the membrane which can readily not be maintained sterile and which interface with the dispensing line after the fitment has been coupled to the coupling means of the fluid manifold system, a preliminary cleaning operating mode is preferably carried out for each new container to prevent immediate contamination of the discharge line when a new container is put in place.

The preliminary cleaning mode can be briefly explained now in combination to FIG. 3. The portion of hose of the container assembly is engaged in the pinch valve 70 that is manually opened by pulling the pinch member from the pinch block 74 to allow the hose to be correctly placed. The fitment 22 with its intact membrane on the end of the hose is slid into the fitment holder of the manifold system. The manifold system is kept in, or move to, a retracted position in which the spear is inset relative to the interface port and the membrane 212. The coupling mechanism is closed by twisting the retaining nut 68 which pulls the holder backward toward the manifold body, clamping down on the fitment and pulling it snuggly against the flat seal 67. The nut can also be replaced by a lever system to compress the fitment against the manifold seal. A cleaning fluid "F" such as hot water or a chemical agent is then circulated into the internal conduit 39 of the cleaning fluid assembly 33 up to the fluid port 41 of the spear. The cleaning fluid flows through this port and across the face of the fitment membrane 212, then, finds its way back into the annular chamber 47 and discharge conduit 48. The cleaning fluid then flows out of the manifold system through the dispensing line 40 further downstream of the dispensing device. The cleaning fluid is circulated during a time sufficient to achieve a proper cleaning of the interface parts of the container assembly. Typically, for hot water as the cleaning fluid heated at a temperature of at least 80° C. or more preferably to about 82 to 90° C., it is sufficient to maintain circulation of from about 40 to 120 seconds in order to kill any hazardous or spoilage-causing micro-organisms. If a chemical agent is circulated, it is recommended to rinse the system with water afterwards to evacuate any remaining chemicals in the discharge line of the manifold system and dispensing line of the dispensing device.

Figure 8:
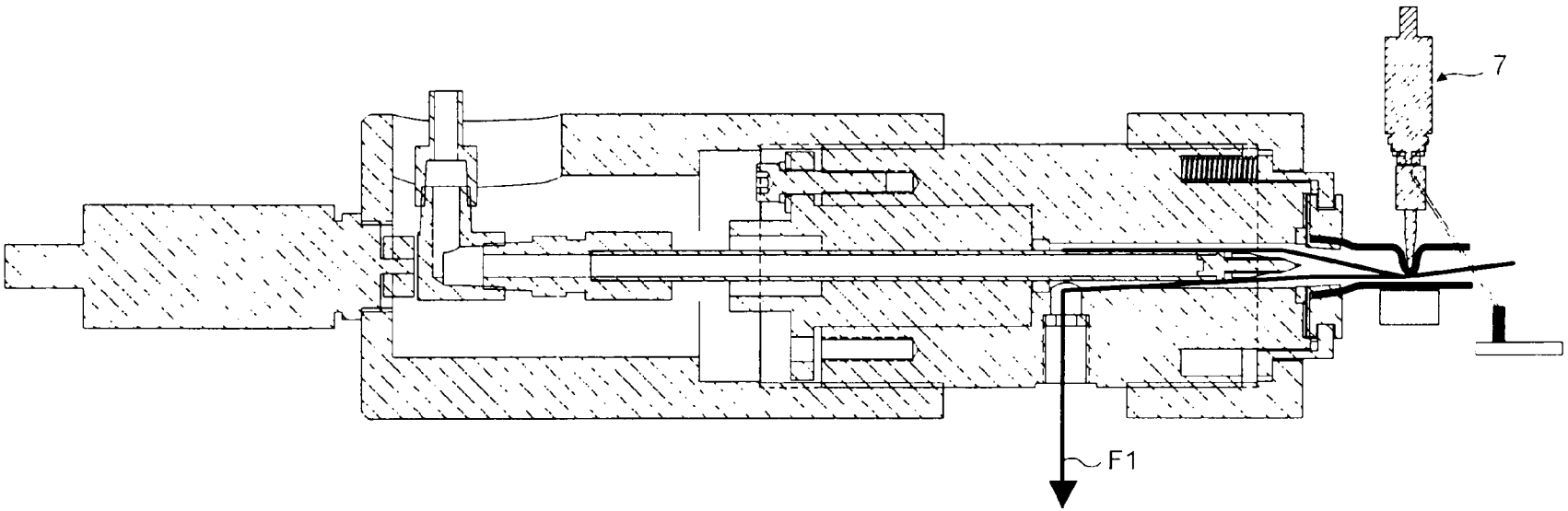
FIG. 8 is a view similar to FIG. 2 but during the discharge of the microbiologically sensitive fluid to the dispensing line.

After this preliminary cleaning mode has been performed, the actuator 62 is energized and tends to move the fluid line assembly 33 forward and, consequently, to push the projection member in the direction of the interface port until the spear 43 of the projection member punctures the membrane 212. Then, the actuator re-energized to pull back the projection member to its original position of FIG. 3 but with the membrane broken. In the retracted position of the projection member, the microbiologically sensitive fluid is ready for dispensing from the container. FIG. 8 shows the milk concentrate route $F_1$ during dispensing while the projection member is retracted. After the operator has pressed a selection switch for selecting the desired beverage, the control valve 502 and pump 50 turn on to begin flow of concentrate. The pressure generated by the pump forces the concentrate past the spring loaded pinch valve 7. The concentrate can thus flow from the manifold system to the mixing device 90. This step occurs for a predetermined period to achieve dosage. After this period, the safety control valve 502, located upstream the pump, shuts off and the pump turns off to stop dispensing the concentrate.

Figure 5:
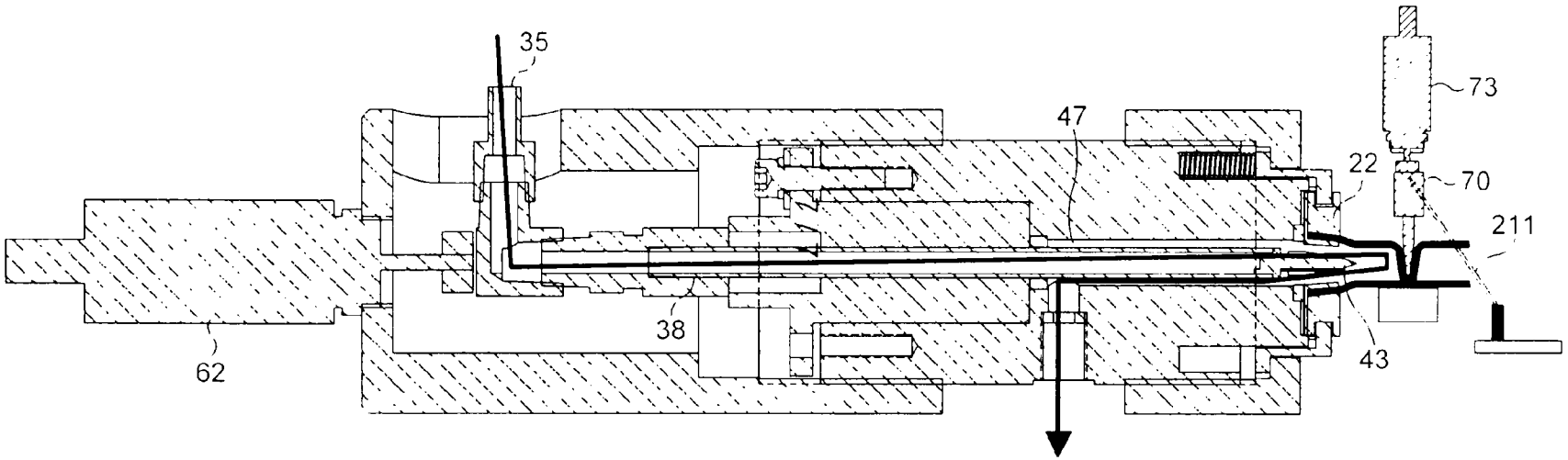
FIG. 5 is a view similar to FIG. 2 showing the periodical cleaning or rinsing of the interior of the terminal end of the container assembly.

Referring now to FIG. 5, it is shown the cleaning or rinsing routine of the terminal fitment and non-sterile portion of hose after breaking of the membrane as performed by the manifold system of the invention. Cleaning and/or rinsing can be carried out periodically depending upon the use rate of the dispensing device, the type of concentrate, the environmental conditions, and other possible factors. In general, the cleaning routine is controlled automatically by a controller that may integrate a clock in order to run a cleaning cycle at regular intervals and so ensure the dispensing device is always in hygienically safe conditions of service. It can be also envisaged to have a switch on the control board of the dispensing device to be able to manually run a cleaning cycle upon request of the operator or maintenance staff. More preferably, several cycles can be daily run, for instance, one cleaning cycle every two or three hours can be run with hot water to both clean and rinse the system and remove microbial sensitive food deposits and, once a day, a full cleaning and sanitization cycle can be run with chemical solutions, followed by subsequent rinsing with hot or cold water, to kill all traces of micro-organisms in the discharge and dispensing lines.

Figure 7:
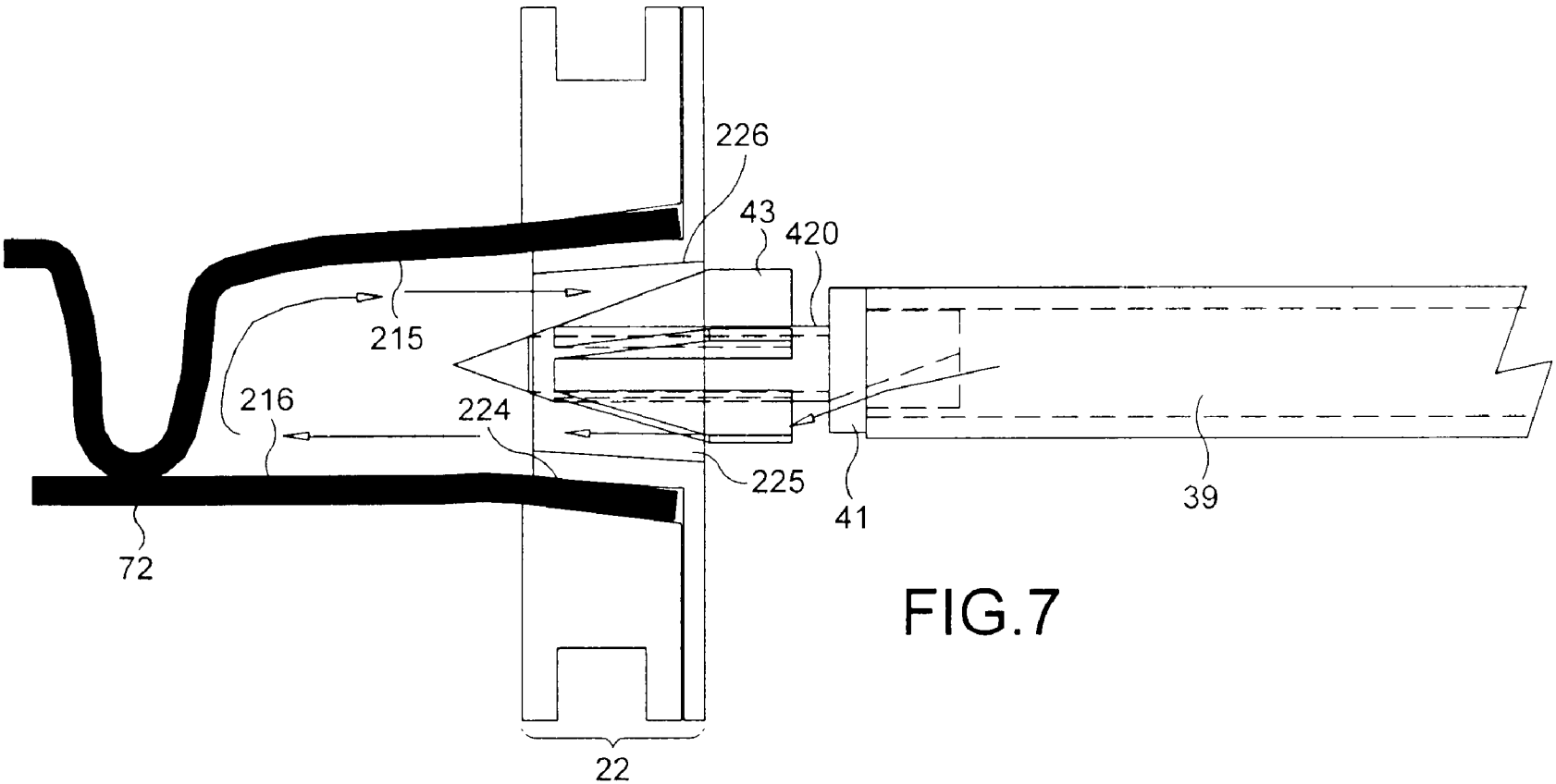
FIG. 7 is a longitudinal schematic view of detail showing the flow path of the cleaning fluid within the fitment and end portion of tube during periodic cleaning or rinsing.

Therefore, in a cleaning mode, the actuator 62 of the sanitary manifold system is energized by electrical impulse causing the projection member 38 with its spear 43 to move toward the fitment 22. The spear is positioned so as to protrude within the fitment as shown in more detail in FIG. 7. Once the spear is in position, the actuator de-energizes. The actuator of the pinch valve energizes applying additional pressure on the spring loaded pinch valve to ensure no leakage of cleaning or rinsing fluid past the valve into the sterile portion of hose 211. Once the pinch valve has reached a pre-determined point (and therefore closing pressure), the second actuator de-energizes. Cleaning fluid is then introduced to the cleaning fluid inlet 35, through the fluid line assembly 33 up to the fluid port 41 as shown in FIGS. 6 and 7. The location of fluid port may vary, but in a preferred embodiment, the fluid port is placed in a slightly offset and rearward position with respect to the tip of the spear. For example, the port is located at an end edge of the axial conduit 39 whereas the axial conduit and spear connect by a zone of reduced diameter 420. The offset position of the fluid port relative to the spear longitudinal axis promotes a direction of fluid circulation along a first side of the fitment surface 224 and hose surface 225. The splines 42, more specifically the two splines on each side of the port, help direct the fluid flow coming out of the port primarily toward the pinch area or point 72 of the hose. The flow strikes the pinch point of the hose and circulates back to the discharge line. Due to the offset positioning of the port and splines the back flow circulation is promoted toward the annular chamber along the other side of the surface 215 of the hose and surface 226 of the fitment. Therefore, the flow circulation avoids any calm zone for the fluid to rest and ensures a perfect cleaning of the inside of the non-sterile terminal end of the container.

After a predetermined cleaning time, the cleaning flow to the manifold system is stopped, the actuator is energizes pulling the projection member with the spear away from the terminal fitment area until the projection member becomes in a fully retracted position as shown in FIG. 2. The valve actuator may also be energized as soon as the cleaning fluid flow has stopped circulating to release the additional pressure on the pinch valve so that the valve remains closed due to the spring tension only. The cleaning has been carried out and the system is ready for dispensing milk concentrate again.

It goes without saying that this cleaning protocol is equally valid for rinsing the device with a rinsing fluid such as hot or cold water.

It is to be noted that the manifold system preferably comprises a single discharge outlet 48 that is arranged to be connected to a dispensing line 40 of the dispensing device 1 as aforementioned. As a result, cleaning or rinsing of the container's interface and dispensing line and components in contact with the milk concentrate can be carried out in the same cleaning or rinsing phase, thus, leading to a simplification of the controls, routings and the general conception of the system.

The device of the invention may further includes heat sealing means arranged to permanently close the hose by heat sealing after the product has been dispensed out of the container. The heat sealing means prevents from refilling the container with product and from re-using the container under conditions that are no longer aseptic and would pose hygienic issue during dispensing. Sealing means may be installed at any suitable part along the hose 21 of the container. For instance, the sealing means may comprise a heater formed by the pinch valve 70 or the block 74 or both. Once the container is empty, the heater is activated to seal the tube at a sealed point, e.g., the pinch point 72, or another preferred area of the hose.

The preparation of a beverage from concentrates may involve the use of various dispensing mechanical components such as a heater for providing hot water on demand, at least one mixer or whipper to mix one or more concentrates with hot or cold water and eventually whip the mixture to create some foam in the beverage, at least one dispensing nozzle to deliver the beverage at a point of dispense in a cup or similar. Preferably, the present invention may be combined to a self-cleaning dispense nozzle that is the subject of co-pending US patent application entitled "Fluid dispensing device with self cleaning nozzle and method of use" filed Apr. 26, 2002; which is incorporated herein by reference.

Further details regarding a preferred container and its fitment can be found in co-pending US patent application filed on even date herewith and entitled "HOSE FITMENT FOR DISPOSABLE FOOD CONTAINER" to P. W. Carhuff; the content of which is expressly incorporated herein by reference.

It will be understood that other modifications and/or adaptations may be made to the manifold system, which has just been described without departing from the scope of the invention defined by the annexed claims.

Although the sanitary manifold system and cleaning and rinsing method using the sanitary manifold system have been described in the context of a beverage dispenser, the invention is not limited to this sole application but could apply to other dispensing applications such as for ensuring hygienic dispensing conditions for soft ice cream, chilled milk-based products, culinary products such as sauces and the like. Also, other engageable or collapsible members can be used to squeeze the tube to form the pinch point, with the specific configuration of such members being chosen by those of ordinary skill in the art.

What is claimed is:

1. A sanitary manifold system for hygienically supplying a microbiologically sensitive fluid from a container to a dispensing unit, wherein the container is adapted to be connected to the system by a terminal connecting portion, comprising:

a housing, a discharge line for delivering the microbiologically sensitive liquid to the dispensing unit, an interface port for establishing a fluid passage from the terminal connecting portion of the container to the discharge line, and a cleaning fluid line assembly for supplying a cleaning or rinsing fluid to clean or rinse the discharge line, and which assembly includes a projection member that delivers cleaning or rinsing fluid within the terminal connecting portion;

wherein the projection member is reciprocally mounted in the housing to move from a retracted position whereby the projection member is positioned relative to the interface port to enable liquid delivery of the microbiologically sensitive liquid from the container to the discharge line, to an inserted cleaning position whereby the projection member protrudes past the interface port and into the terminal connecting portion of the container to deliver cleaning or rinsing fluid therein so that the microbiologically sensitive fluid can be removed from the manifold system as the cleaning or rinsing fluid passes from the terminal connection portion, through the interface port and through the discharge line to the dispensing unit.

2. The sanitary manifold system according to claim 1, wherein the projection member has a terminal spear adapted to puncture a closing membrane of the terminal connecting portion.

3. The sanitary manifold system according to claim 2, wherein the projection member comprises a plurality of cutting spines on the external surface of the spear.

4. The sanitary manifold system according to claim 1, wherein the projection member includes a fluid inlet, a fluid port and a tubular hollow conduit that extends therebetween to supply cleaning or rinsing fluid within the terminal connecting portion.

5. The sanitary manifold system according to claim 1, wherein the discharge line extends from the interface port to a discharge outlet, at least partially, by a chamber located about the projection member to promote return of the cleaning or rinsing fluid through the terminal connecting portion of the container.

6. The sanitary manifold system according to claim 1, which further comprises coupling means to watertightly secure a fitment of the terminal connecting portion of the container at the interface port.

7. The sanitary manifold system according to claim 6, wherein the coupling means comprises a spring loaded holder that has a complementary fit to receiving means of the fitment, a seal between the interface port and fitment outlet, and a pressure means urging the receiving means of the fitment against the seal.

8. The sanitary manifold system according to claim 1, wherein the projection member is actuated by an actuator adapted to move the projection member between the retracted and inserted cleaning/rinsing positions.

9. The sanitary manifold system according to claim 1, wherein the container comprises a package and hose and wherein an external valve is provided proximate the interface port to maintain the hose and package sterile and isolated from the terminal connecting portion to allow cleaning or rinsing of the hose from the interface port up to the closing point of the valve.

10. The sanitary manifold system according to claim 9, wherein the valve is a spring loaded pinch valve that that closes a portion of hose at a pinch point to demarcate a sterile part of the container at the pinch point.

11. The sanitary manifold system according to claim 10, which further comprises an actuator coupled to the spring loaded pinch valve to raise the threshold tension value acting on the hose that exceeds the pressure caused by flow of cleaning fluid discharged within the terminal connecting portion up to the pinch point.

12. A combination of the sanitary manifold system of claim 1 and a container adapted to be connected to the system by a terminal connecting portion that includes a fitment for hygienically supplying microbiologically sensitive fluid from the container to a dispensing unit, wherein the container comprises:

an aseptic source of microbiologically sensitive product, the terminal connecting portion and fitment, and a portion of hose connecting the source to the terminal connecting portion and fitment.

13. The combination according to claim 12, wherein the flow of the microbiologically sensitive fluid is controlled by a pinch valve that closes a portion of hose at a pinch point and wherein the projection member delivers cleaning or rinsing fluid inside the fitment and hose up to the pinch point.

14. The combination according to claim 12, wherein the terminal connecting portion and fitment are free of an internal valve and are closed by a puncturable membrane, and wherein the sanitary manifold assembly includes puncturing means to puncture the membrane and open the fitment.

15. The combination according to claim 12, wherein the sanitary manifold assembly includes coupling means and the fitment includes receiving means to engage the coupling and securely engage and lock the fitment at the interface port.

16. The combination according to claim 12, wherein the container comprises a package that includes a shelf stable milk-based concentrate.

17. The sanitary manifold system of claim 1 further comprising a container adapted for hygienically supplying microbiologically sensitive fluid and removably connected to the sanitary manifold system, the container comprising:

an aseptic source of microbiologically sensitive product, a fitment associated with the connecting terminal portion, a portion of hose connecting the source to the terminal portion and fitment, and a closing means that maintains the source aseptic before the first opening of the container.

18. The container according to claim 17, wherein the source of microbiologically sensitive product is a shelf stable concentrate of milk.

19. A device for hygienically supplying microbiologically sensitive fluid from a removable container comprising a hose, a package and a terminal connecting portion to a dispensing unit, wherein the container includes an external valve to act externally on a portion of the hose to maintain the hose and container sterile and isolated from the terminal projecting portion, and the device comprises:

coupling means adapted to connect to the terminal connecting portion;

an interface port for establishing a fluid passage from the terminal connecting portion of the container to the discharge line; and cleaning means for delivering a cleaning or rinsing fluid within the terminal connecting portion;

wherein the cleaning means comprises a projection member reciprocally mounted for movement from a retracted position whereby the projection member is positioned relative to the interface port to enable liquid delivery of the microbiologically sensitive liquid from the container to the dispensing unit, to an inserted cleaning position whereby the projection member protrudes past the interface port and into the terminal connecting portion of the container to deliver cleaning or rinsing fluid therein so that the microbiologically sensitive fluid can be removed from the device as the cleaning or rinsing fluid passes from the terminal connection portion, through the interface port and to the dispensing unit.

20. The device according to claim 19, wherein the cleaning means comprises cleaning lines adapted to deliver a cleaning fluid selected among the group consisting of hot water, a chemical sanitizing agent and steam.

21. The device according to claim 19, wherein it further comprises heat sealing means arranged to engage and permanently seal a portion of the container.

* * * * *